US005269706A

United States Patent [19]

Spanio

[11] Patent Number: 5,269,706

[45] Date of Patent: Dec. 14, 1993

[54] MODULAR FUSE-HOLDER DEVICE FOR CONNECTION TO A SWITCH OR THE LIKE

[75] Inventor: Marino Spanio, Milan, Italy

[73] Assignee: Bremas S.p.A., Italy

[21] Appl. No.: 903,889

[22] Filed: Jun. 25, 1992

[51] Int. Cl.[5] ..... H01R 13/68

[52] U.S. Cl. ..... 439/621; 337/209

[58] Field of Search ..... 439/621, 622; 337/186–188, 191–193, 203, 209; 361/430, 431

[56] References Cited

U.S. PATENT DOCUMENTS

| | | | |
|---|---|---|---|
| 1,966,716 | 7/1934 | Green | 337/209 |
| 3,159,730 | 12/1964 | Staffel | 337/192 |
| 3,879,695 | 4/1975 | Oakland et al. | 337/209 |
| 4,149,215 | 4/1979 | Strich | 361/430 |
| 4,808,962 | 2/1989 | Ikeda | 337/203 |

FOREIGN PATENT DOCUMENTS

| | | | |
|---|---|---|---|
| 2458553 | 6/1975 | Fed. Rep. of Germany | 439/622 |
| 193214 | 4/1964 | Sweden | 337/188 |

*Primary Examiner*—Gary F. Paumen

*Attorney, Agent, or Firm*—Steinberg & Raskin

[57] ABSTRACT

A fuse-holder comprising a body in which at least one seat is provided for receiving at least one fuse and to act as a guide and support for closure plugs which make contact with one end of the fuses. The fuse-holder is connected to at least one second electrical unit and has contact devices arranged to cooperate at one end with the plugs and at their other end with at least one further electrical connection member. The fuse-holder also includes apertures to be penetrated by flat pins of the second electrical unit for contact with the base of the fuses.

15 Claims, 3 Drawing Sheets

MODULAR FUSE-HOLDER DEVICE FOR CONNECTION TO A SWITCH OR THE LIKE

BACKGROUND OF THE INVENTION

This invention relates to a fuse-holder device.

Electrical devices are known comprising both a switch and a fuse-holder within a single element.

These known devices are difficult and laborious to assemble because of the large number of components and connection means for assembling the two different units within a single body.

These known devices can contain fuses only of a determined type, hence the body of the entire device has to be changed if fuses of a different type have to be used. These are some of the significant drawbacks of the prior art devices.

OBJECTS AND SUMMARY OF THE INVENTION

An object of the present invention is to overcome the aforesaid drawbacks of the known art.

These and further objects which will be apparent to the expert of the art on reading the ensuing description are attained according to the invention by a fuse-holder comprising a body in which at least one seat is provided for receiving at least one fuse and to act as a guide and support for closure plugs which make contact with one end of the fuses; means for connection to at least one additional electrical unit; contact means arranged to cooperate at one end with the plugs and at their other end with at least one electrical connection member; and apertures to be penetrated by flat pins of the additional electrical unit for contact with the base of the fuses.

In particular, the electrical connection member(s) or device(s) can be a terminal block applied to a wall of the fuse-holder such that the contact means can penetrate into the relative seats of the block, so making the device irremovable from the wall to which it is applied.

The fuse-holder of the invention is simple to assemble and comprises only a small number of components, which can be easily constructed by moulding. In addition it can be modularly combined with various types of electrical units and in particular with a switch device, and only the body of the fuse-holder has to be replaced if fuses of different type and size have to be used.

BRIEF DESCRIPTION OF THE DRAWINGS

A preferred embodiment of the device of the invention is illustrated by way of non-limiting example in the accompanying figures, of which.

DETAILED DESCRIPTION OF THE INNVENTION

Figure 1:
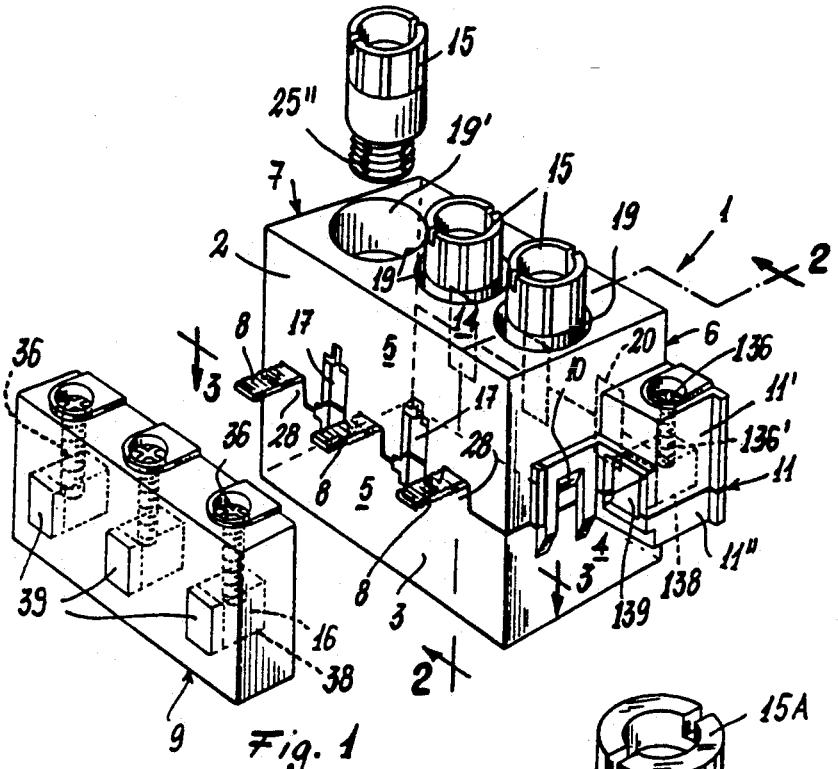
FIG. 1 is a perspective view of the fuse-holder device according to the invention.
Figure 2:
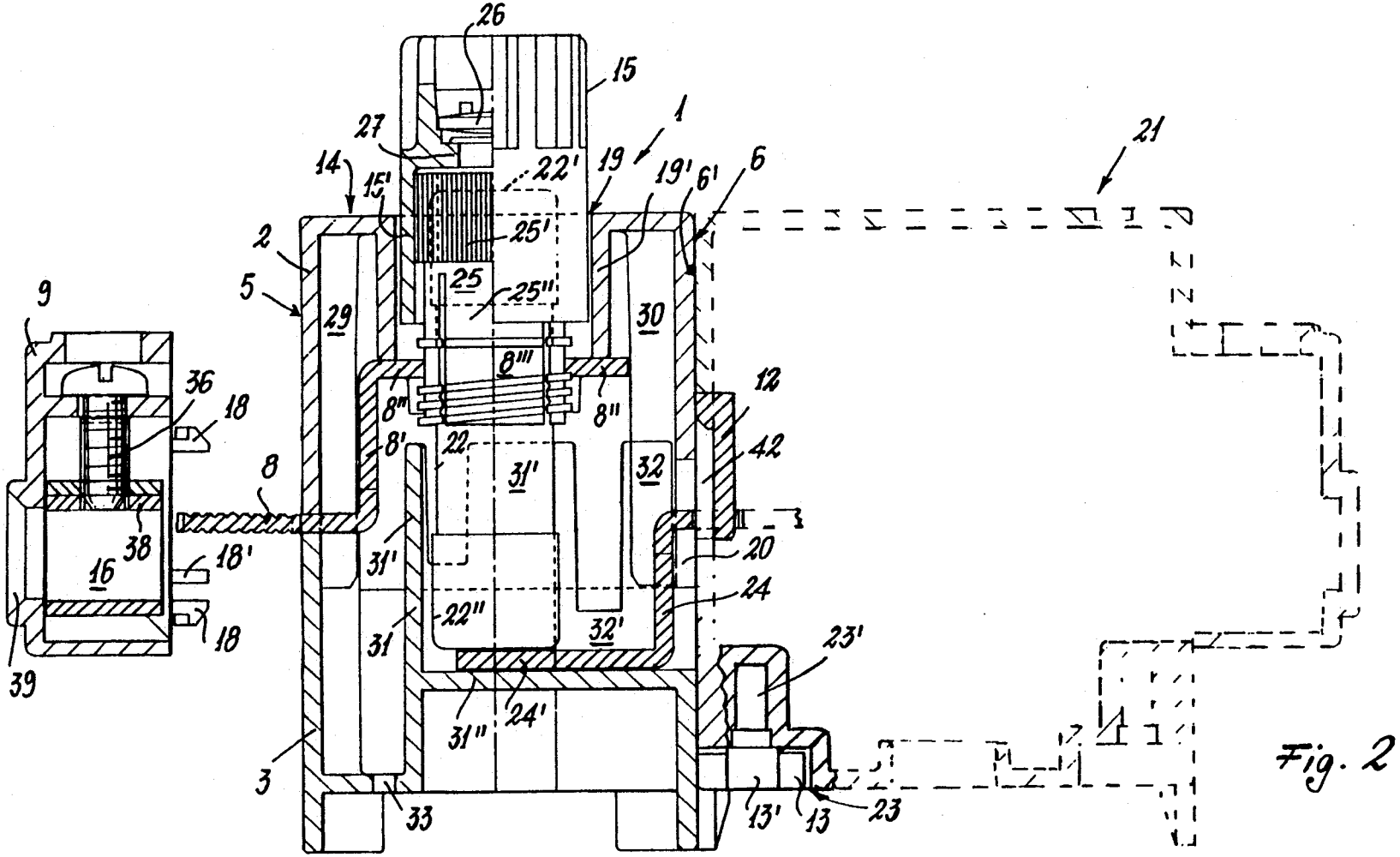
FIG. 2 is a section through the fuse-holder on the line 2'—2' of FIG. 1.
Figure 3:
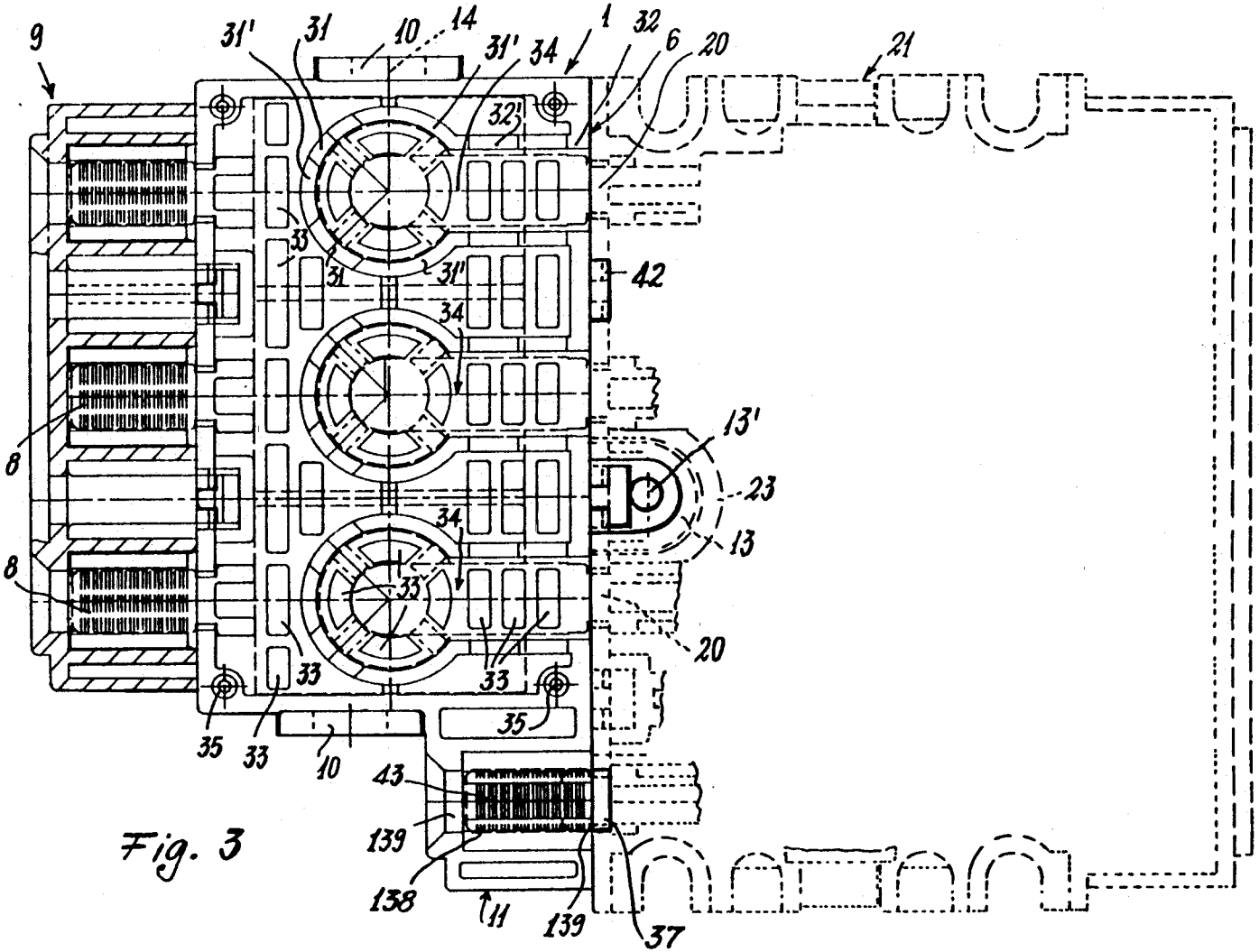
FIG. 3 is a section through the fuse-holder on the line 3'—3' of FIG. 1.

FIGS. 1, 2 and 3 show the fuse-holder device of the invention, which is of substantially parallelepiped form and comprises a body 1 consisting of an upper part 2 and a base part 3 defining the four side walls 4, 5, 6, 7. As a result of the parallelepiped form, each of the side walls 4, 5, 6 and 7, the top surface of the upper part 2 and the bottom surface of the base part 3 are parallelograms having opposite side which are parallel. Snap-type connection elements 10 are provided on the walls 4 and 7 of the device for fitting the upper part 2 to the base 3. A terminal holder 11 projects from side wall 4, the upper part 11' of the holder 11 forming part of the upper part 2 of the body 1 whereas its lower part 11" forms part of the base 3 of the body 1.

Three flat contact pins 8 project from the side wall 5 in a direction perpendicular thereto for insertion into relative seats 16 arranged in a terminal block 9. The terminal block 9 is provided with screws 36 screw holes 36', apertures 39 and a cage 38 of conducting material, and can be connected to the wall 5. For this purpose, the wall 5 comprises two parallel vertical slots 17 into which projecting elements 18, 18' of the block 9 can be inserted.

From the wall 6 of the block 1 there project three inverted T-shaped coupling elements 12 as shown in FIG. 2. The coupling elements 12 are positioned parallel to each other for insertion into three suitable slots 42 to form a bayonet connection with a device to which the fuse-holder is to be connected. A semi-cylindrical projection 13 is provided with a hole 13' (best seen in FIG. 3) and projects from the bottom of the wall 6.

In the wall 6, as shown in FIG. 2, there are also provided three rectangular apertures 20, these being parallel to each other and to the coupling elements 12.

The wall 14 of the upper part 2 of the body 1 comprises three circular seats 19 which act as guides and supports for three hollow, cylindrical screw-closure and contact plugs, or screw-contact devices, 15 removably arranged parallel to each other preferably along the major central axis of the wall 14.

As can be seen in particular in FIGS. 2 and 3, the cylindrical seats 19 extend for a certain portion 19' into the body 2 to act as guides for the screw-contact devices 15. These devices comprise a first outer shell of insulating material 15' into which a hollow cylindrical contactor member 25 of conducting material and a transparent element 26 are forcibly inserted. The transparent element rests on a circular shoulder 27 of the shell 15'. The contactor member 25 comprises a first knurled part 25' forced into the shell 15', a second part comprising a holed shank (not shown) inserted into a hole in the shell 15', this shank being riveted to the shell 15', and a third threaded part 25". Each flat contact pin 8, which rests on a step 28 (FIG. 1) forming part of the base 3, extends in S form within the body 2 and comprises a first rectangular portion 8' wider than the width of the flat pin 8 and resting on a shoulder 29, and a second portion 8" comprising a region having a threaded circular opening 8"' therein. The second portion 8" rests on the ends of the portion 19' and on the shoulders 30. The threaded circular opening 8"' engages with the threaded portion 25" of the contactor member 25.

The base 3 comprises internally a hollow semi-cylindrical surface 31 from which extend three circular shoulders 31' arranged parallel to each other along the major axis of the base 3. The surfaces 31 and shoulders 31' are centered axially about the seat 19, the plug 15 and the ring nut 8", and are sized to be able to act as a guide for the relative and corresponding fuse.

The base 3 also comprises shoulders 32 (FIG. 2) arranged so that when the fuse-holder is assembled, the shoulders 32 rest on the shoulders 30 of the upper part of the body 2. In the base 3 there are also provided shoulders 32' which connect to the shoulders 31' and to the semi-cylindrical surface 31 which in correspondence with these shoulders comprises a rectangular aperture 34 along its entire surface (see FIG. 3). As can be seen in FIG. 3, the base 3 also comprises in a bottom surface thereof, a plurality of aeration holes 33 and four guides 35 for its fitting and coupling to the upper part of the body 2. The terminal holder 11 (FIGS. 1 and 3) is composed of two parts 11' and 11" projecting from the upper part 2 and from the base 3 of the body 1 respectively. The part 11' comprises, in a similar manner to the arrangement of the terminal block 9, a hole 136 in which a screw 136 is inserted. The screw 36 connected to a cage 138 of conducting material, in correspondence with which the terminal holder comprises two apertures. Both the screw 136 and the cage 138 are completely contained within the terminal holder 11 when the fuse-holder device has been assembled.

In FIGS. 2 and 3 the fuse-holder device 1 is shown with a fuse 22 (shown dashed in FIG. 2) inserted, and fitted to a switch unit 21 (shown dashed in FIGS. 2 and 3) by the inverted T-shaped coupling elements 12 and the semi-cylindrical projection 13. The coupling elements 12 cooperate with three suitable shaped slots 42 in a face 6' of the unit 21 so as to form a bayonet connection with the inverted T-shaped coupling elements 12. The projection 13 is inserted (as shown in FIG. 2) into a suitably shaped seat in the bottom of the unit 21 and is then fixed to this unit by a screw inserted through the hole 13' in the projection 13 and screwed into a seat 23' in the unit 21.

On the face 6' of the unit 21, there are also provided three L-shaped flat pins 24 arranged parallel to each other. When the unit 21 is fitted to the fuse-holder 1, the flat pins 24 pass through the apertures 20 and, guided and supported by the shoulders 32 and 31', penetrate into the fuse-holder 1. Specifically, the end 24' of these flat pins penetrates into the hollow semi-cylindrical surface 31, 31' by passing through the slot 34 provided in said surface, so that the end 24' rests for a certain length on the base 31" of the semi-cylindrical surface 31. In addition, when the fuse-holder is fitted to the unit 21, a fourth flat pin 43, also provided on the surface 6' of the unit parallel to the flat pins 24, penetrates into the terminal holder 11 (as shown in FIG. 3), passing through the aperture 139 to be received within the cage 138.

The operation and use of the fuse-holder are as follows. The fuse-holder 1 must firstly be fitted to an electrical unit. In this specific case the electrical unit is a switch 2 provided with slots 42 and with a recess 23 shaped to be able to be penetrated by the inverted T-shaped coupling elements 12 and by the semi-cylindrical projection 13, and with L-shaped flat pins 24 and 43 to penetrate into the body of the device 1 through the apertures 20 and 37, and rest on the base 31" of the surface 31 and in the terminal holder 11, respectively.

In this manner, the fuse-holder and the unit 21 to which it is fitted form a single compact modular item.

The three plugs 15 are then unscrewed from their respective seats 19 and three fuses 22 are inserted into the seats 19, the plugs 15 then being again screwed down. In this manner the contact surface 22' of the fuse becomes connected to the contactor member 25' of the plug 15 and to the threaded opening 8', and hence to the flat pin 8. By this means, the contact surface 22" of the fuse becomes simultaneously connected to the end 24' of the L-shaped flat pin 24 of the unit 21. The respective feed cables are now inserted through the slots 139 and 39' and into the terminal blocks 9 and 11 respectively, to be then connected to the flat contact pins 8 and 43 by screwing down the screws 36 and 136, which act on the cages 38 and 138, respectively.

Figure 4:
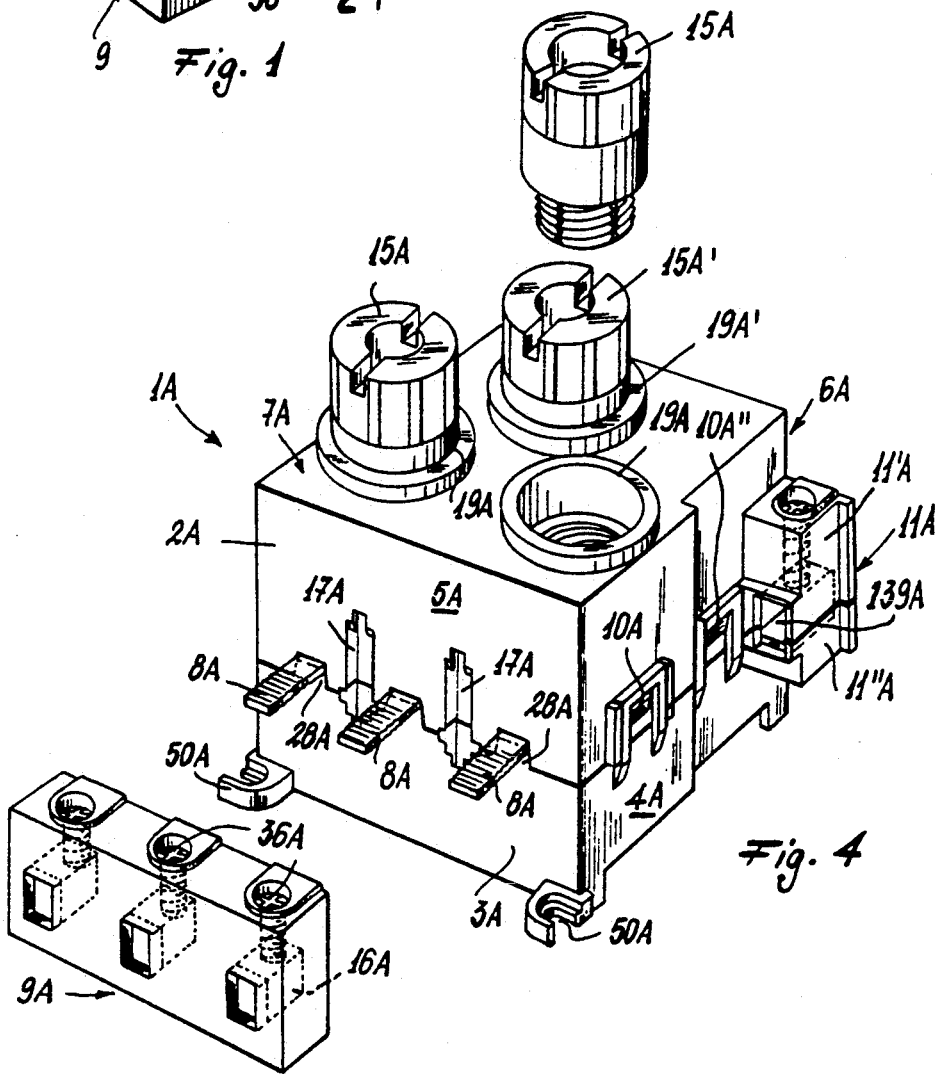
FIG. 4 is a perspective view of a second embodiment of the device.

In a modification to the described embodiment, the two parts 2 and 3 of the fuse-holder device are connected together by security closure screws in addition to the described snap connection. In the illustrated embodiment of the present invention the inserted fuses have a given size. In a second embodiment of the invention the inserted fuses are of a greater size. This second embodiment (illustrated in FIG. 4) comprises substantially the same components as previously illustrated, and these therefore carry the same reference numerals but with the addition of the letter A.

Because of the change in the size of the fuses to be inserted, the dimensions of the body of the fuse-holder device also change. Specifically, the dimensions of the seats 19A into which the fuses are inserted change, as does their arrangement, which instead of being in the form of three parallel seats are now in the form of three seats arranged as a triangle.

Consequently the length of the walls 4A and 7A changes while the length of the walls 2A and 6A remains unchanged, so that the terminal block 9A and an electrical unit 21 can still be connected without modification. In addition the dimensions of the contact plugs 15, the threaded circular opening 8''' and the part 8' of the flat contact pins within the device change.

Specifically, in this embodiment only the flat contact pin parts 8' relative to the seats 19A remain unchanged. The flat pin part 8' relative to the seat 19A' must obviously be longer.

The interior of the body 2A and of the base 3A have a shape substantially equal to that shown in FIGS. 2 and 3, except for the obvious modifications necessary as a consequence of the changed dimensions of the device.

The switch unit 21 (not shown in FIG. 4) to which the fuse-holder 1A is fitted will have its flat contact pins (indicated by 24 in FIGS. 2 and 3) dimensioned so that they can reach the base contact portion 22" of the fuses when these are inserted into the seats 19A and 19A'. The unit 21 must therefore comprise flat contact pins 24 with their portion 24' much longer than in the preceding embodiment.

The base 3A also comprises two arched elements 50A for fixing the device to a wall.

I claim:

1. A modular fuse-holder device, comprising a body having an upper part, a lower part and first and second mutually opposite, substantially flat surfaces, said upper part and said lower part having adjacent corresponding surfaces and being separable from each other, substantially S-shaped electrically conductive means having a first enlarged end extending within said body and a second end protruding at right angles from said first surface, threaded coupling means arranged in said first end of said conductive means, fuse-housing means arranged in said lower part for supporting at least one fuse, access means arranged in said upper part and opening into said second surface, said access means communicating with said fuse-housing means to enable penetration of contact means of an electric unit within said upper part to thereby establish electric contact between the at least one fuse and the electric unit, tubular guide means arranged in a top surface of said upper part of said body, said tubular guide means being aligned with said threaded coupling means and also with said fuse-housing means, a cap comprising an electrically conductive hollow threaded portion structured and arranged to engage with said threaded coupling means and to pass through said tubular guide means to establish electric contact between said conductive means and the at least one fuse, and coupling means arranged on said second surface for removably connecting said body to the electric unit arranged adjacent thereto.

2. The device of claim 1, further comprising first connecting means to connect said lower part to said upper part.

3. The device of claim 1, wherein said cap comprises an insulating shell, a transparent element, and a contactor member arranged to contact an end of the at least one fuse.

4. The device of claim 1, wherein said coupling means comprise at least one inverted T-shaped coupling element arranged on said body and at least one semi-cylindrical projection arranged on said body, said coupling element being insertable into corresponding slots on the electrical unit and said semi-cylindrical projection being insertable into a recess provided on the electrical unit.

5. The device of claim 1, further comprising at least one electrical connection member arranged adjacent to said first surface.

6. The device of claim 5, wherein said threaded coupling means comprise a substantially circular threaded opening arranged in said first end, and said conductive means further comprise a substantially flat pin arranged at said second end, said flat pin projecting from said first surface and penetrating into corresponding seats arranged in said at least one connection member, said cap further comprising a contactor member engaging with said substantially circular threaded opening.

7. The device of claim 1, further comprising at least one terminal holder arranged on a side surface of said body at right angles to said first and second surfaces, said at least one terminal holder cooperating with a flat pin connected to the electric unit.

8. The device of claim 1, further comprising a plurality of aeration holes arranged in at least one of said upper part and said lower part, said fuse-housing means comprising at least one part arranged as a guide and support for the at least one fuse.

9. The device of claim 5, wherein said at least one electrical connection member comprises a terminal block having second connection means arranged on a surface thereof to couple said terminal block to said device, said second connection means comprising projecting connection elements arranged on said terminal block to engage with corresponding slots arranged on said device.

10. The device of claim 2, wherein said first connecting means comprise snap-type connection elements arranged on opposite surfaces of said upper part and said lower part at right angles to said first and second surfaces, and guides arranged in said lower part.

11. The device of claim 1, wherein said top surface is arranged at a right angle to said first and second surfaces such that said cap is arranged in said tubular guide means in a direction parallel to said first and second surfaces.

12. The device of claim 7, wherein said at least one terminal holder comprises an upper part and a lower part, said upper part of said device including said upper part of said at least one terminal holder, said lower part of said device including said lower part of said at least one terminal holder.

13. The device of claim 1, wherein said device is arranged to hold three fuses arranged along an axis of a top surface of said device.

14. The device of claim 1, further comprising securing means arranged on said device for securing said device to a wall.

15. The device of claim 1, wherein said device is arranged to hold three fuses arranged in a triangular configuration.

* * * * *